United States Patent [19]

Graham, Jr. et al.

[11] 4,396,163

[45] Aug. 2, 1983

[54] LEVER OPERATED TRANSFER TOWEL DISPENSER

[75] Inventors: Andrew S. Graham, Jr., Wyncote; Coleman D. Berg, Philadelphia, both of Pa.

[73] Assignee: Fleck Industries, Inc., Willow Grove, Pa.

[21] Appl. No.: 281,833

[22] Filed: Jul. 9, 1981

Related U.S. Application Data

[63] Continuation-in-part of Ser. No. 166,751, Jul. 7, 1980, Pat. No. 4,317,547.

[51] Int. Cl.[3] ..... B65H 19/04

[52] U.S. Cl. ..... 242/55.3

[58] Field of Search ..... 242/55.3, 55.53, 58.4; 312/39–41; 226/91; 83/345

[56] References Cited

U.S. PATENT DOCUMENTS

| | | | |
|---|---|---|---|
| 2,826,373 | 3/1958 | Schwartz | 242/55.3 |
| 4,106,684 | 8/1978 | Hartbauer et al. | 226/91 |
| 4,137,805 | 2/1979 | DeLuca et al. | 83/345 |
| 4,165,138 | 8/1979 | Hedge et al. | 312/39 |
| 4,307,638 | 12/1981 | DeLuca et al. | 83/37 |
| 4,317,547 | 3/1982 | Graham, Jr. et al. | 242/55.3 |

*Primary Examiner*—Leonard D. Christian

*Attorney, Agent, or Firm*—Kenneth P. Synnestvedt

[57] ABSTRACT

A lever operated mechanism for dispensing paper toweling, particularly from a transfer type of towel dispenser for sequentially delivering toweling from a primary roll in a first station and from a secondary roll in a second station and including a two-way actuable lever and a toothed rack movable in opposite directions by the lever and meshing with the teeth of a drive gear which is shiftably mounted, thereby providing for feed of the toweling upon movement of the lever in either direction, without the necessity for employment of clutches.

6 Claims, 9 Drawing Figures

LEVER OPERATED TRANSFER TOWEL DISPENSER

CROSS REFERENCES

The present application is a continuation-in-part of our prior application Ser. No. 166,751, filed July 7, 1980, U.S. Pat. No. 4,317,547.

BACKGROUND AND STATEMENT OF OBJECTS

The invention is concerned with paper towel dispensers, particularly dispensers adapted to accommodate a primary roll in a first station and a secondary roll in a second station, with provision for transfer mechanism automatically operative to feed toweling sequentially from the primary roll and then from the secondary roll upon exhaustion of the primary roll.

In one aspect, the present invention is particularly concerned with the provision of a novel form of two-way lever actuating mechanism for delivering paper toweling or the like from a dispenser; and certain aspects of the lever actuating mechanism are applicable either to a transfer dispenser of the kind referred to above or even to a dispenser accommodating only a single roll of paper toweling or the like.

The invention is also concerned with features of a transfer dispenser including the construction of mounting means for the primary and secondary rolls and for effecting the transfer of paper feed from one roll of toweling to another; but it is to be understood that various of the features are applicable to dispensers for other continuous webs, for instance, toilet tissues or any other web supplies involving primary and secondary sources from which it is desired to effect the feed sequentially, first from the primary supply and then from the secondary supply. Since the invention is of special utility in the field of paper towel dispensers, such as those commonly installed in toilet rooms, the invention is herein illustrated and described as applied to an embodiment of a paper towel dispenser.

As is shown, transfer dispensers commonly are enclosed in a cabinet and incorporate two roll accommodating stations, one of which is herein identified as the primary roll station, and the other as the secondary roll station. The general purpose of this configuration is to facilitate janitorial maintenance while at the same time assuring constant availability of toweling supply. In a typical embodiment, the roll in the primary station has only a minor fraction of the total toweling initially included in that roll, and the web from the primary roll is threaded through the feed mechanism and is discharged or delivered from the dispenser, frequently by the turning of a handcrank or actuation of a lever. The second station, provided for the secondary roll, accommodates a fresh or full roll which remains as a reserve supply in the dispenser until the web from the primary roll is exhausted.

When the attendant or service personnel inserts a new roll in the secondary station, the roll which had previously occupied that position is first shifted to the primary station, the web of this roll remaining in engagement with the feed mechanism; and then the web of the secondary roll is brought into a position near the feed mechanism, but not in engagement therewith. In transfer dispensers, provision is made for introducing the web of the secondary roll into the feed mechanism either toward the end of the feed of the web from the primary roll or after complete exhaustion of the primary roll web.

Several different forms of dispensers of the general type referred to above are known, but certain types of problems arise with various of the prior known dispensers. For example, in some cases, the transfer of feed from the primary roll to the secondary roll has a tendency to occur prior to complete exhaustion of the paper web from the primary roll, with consequent concurrent delivery of both webs during the feed of the final portion of the primary roll web. This represents a waste of paper, and the arrangement of the present invention is adapted to assure that the feed of the web from the secondary roll does not occur until complete or at least substantially complete exhaustion of the web from the primary roll.

In some of the prior dispensers, the transfer operation is unreliable at least from time to time; and in consequence, in some cases, the primary roll web is exhausted and the secondary roll web is not delivered at the time of exhaustion of the primary web. Another objective of the present invention is to greatly increase the reliability of the transfer function.

In some instances in prior arrangements, the transfer mechanism has been arranged to engage the web in only a single relatively limited region transversely of the secondary roll web between the side edges thereof; and in some cases where the leading end of the secondary roll web has been torn off or folded under in the region where the transfer mechanism would normally operate, the transfer would be unreliable or might fail. It is an object of the present invention to overcome problems of this type, particularly by providing more than one transfer device respectively engageable with the web of the secondary roll in spaced regions thereof, preferably adjacent to each side edge thereof. In this way, if one edge or corner piece of the web from the secondary roll is torn off or folded under, the transfer will be effected by the transfer mechanism associated with the other edge of the web.

Still further, in some prior arrangements, there is a tendency under certain conditions for the transfer mechanism to be prematurely triggered. Sometimes, this can happen as a result of an impatient towel user delivering a manual blow to the cabinet, and thereby jarring internal parts to such an extent as to prematurely trigger the transfer. It is also an objective of the present invention to positively assure against premature triggering of the transfer mechanism at least until a point representing substantial exhaustion of the primary web.

In a typical transfer dispenser, the feed mechanism includes a pair of parallel shafts having at least one pair of cylindrical web gripping and feeding surfaces providing a feed nip for paper webs delivered from a roll either in the primary or in the secondary station; and mechanism is provided for manually rotating one of the pair of shafts of the feed mechanism, the mechanism for this purpose disclosed in our copending application above fully identified, taking the form of a handcrank connected with said one shaft of the pair. In the present application, instead of using a handcrank, we have disclosed a novel form of lever actuated mechanism arranged to transmit the driving force to the feed roll through a gearing arrangement which eliminates the necessity for employment of any one-way clutches or the like, as employed in certain prior lever operated toweling feed mechanisms.

In another aspect, the present invention provides a lever operated mechanism which not only provides two-way operation but which also includes means effective to avoid overload of the mechanism in either direction of operation of the lever.

BRIEF DESCRIPTION OF THE DRAWINGS

How the foregoing general objectives of the invention are achieved, and various other advantages thereof, will appear more fully from the following description referring to the accompany drawings, in which.

DETAILED DESCRIPTION

Figure 2:
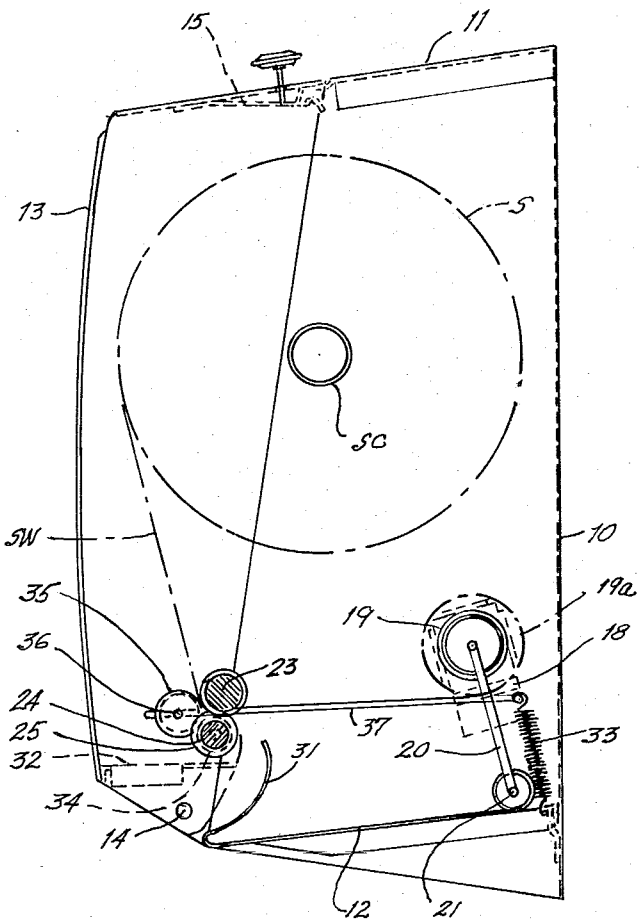
FIGS. 1 and 2 are side elevational views, embodying a somewhat diagrammatic illustration of the principal parts, and the action thereof, in effecting transfer of paper toweling feed from a primary roll to a secondary roll in a transfer type of dispenser of the kind disclosed in our copending application above referred to, these views showing some parts in vertical section and the views being taken generally as indicated by the section line 1—1 on FIG. 4.

Although the mechanism of the present invention may be mounted on any desired type of supporting structure, in a typical case, the mechanism is mounted within a cabinet having a displaceable closure, and an example of such a cabinet is illustrated in the drawings. The cabinet shown has side walls 9—9, a back wall 10, a top wall 11 and a bottom wall 12. The front of the cabinet is open but has a cover or closure member 13 which may be variously arranged, but which, as shown in FIG. 1, is hinged to the side walls 9 as indicated at 14, being provided with a releaseable latch 15 at the upper edge, so that for replacement of the secondary roll, the cabinet may be opened for convenient access at the front.

The secondary or reserve roll, such as indicated at S, is mounted in the secondary roll station by means of mounting brackets here shown as formed of bent wire pieces 16 mounted on the back wall 10 of the cabinet, with portions thereof bent, as indicated at 17, in the form of bearing supports for engaging in the end openings of the core SC of the secondary roll S. The supports carry abutment discs 17*a* adapted to engage the end of the roll. The specific configuration of the secondary roll mounting parts forms no part of the present invention per se, and these parts may be otherwise constructed, so long as they provide for the support of the secondary or reserve roll in the secondary station, preferably in the upper region of the cabinet.

Figure 1:
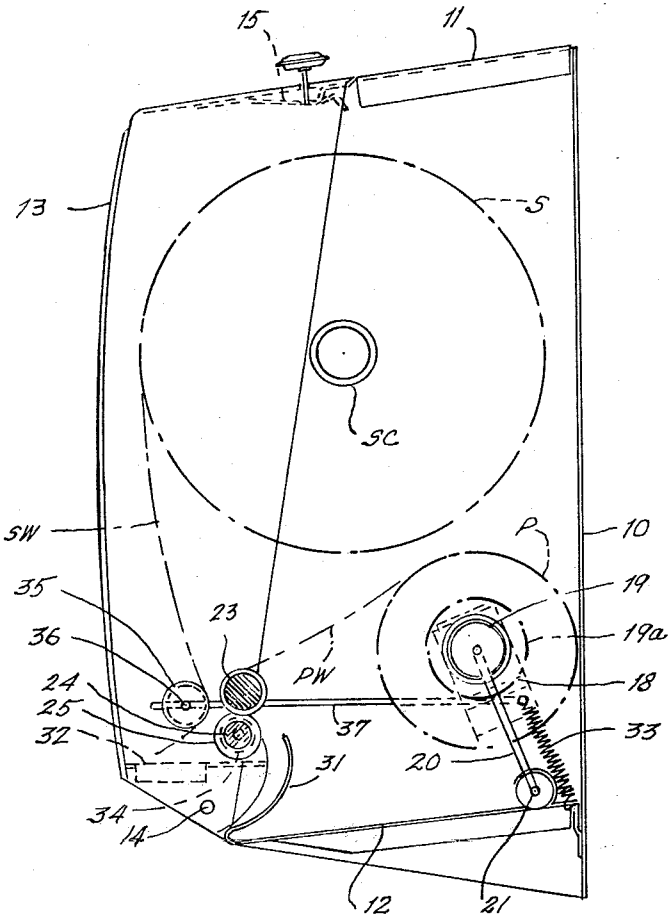

In typical maintenance procedure, after a substantial amount of the secondary roll web has been depleted, the secondary roll is moved into the primary station, as indicated at P in FIG. 1. The primary station is provided by a pair of supporting devices, one form of which appears in FIGS. 1, 2 and 4, being identified by the numeral 18 carrying a journal part 19 adapted to engage in the end of the roll core of the primary roll and an abutment disc 19*a* adapted to engage the end of the roll when the roll is moved to the primary roll station. The journal devices 18 are mounted by means of arms 20 which extend downwardly to a point close to the bottom wall 12 of the cabinet and which are pivotally mounted, as indicated at 21, in the bearing supports 22 (see FIGS. 3 and 4). Positioning brackets 20*a* mounted on the bottom wall 12 serve to maintain the arms 20 in the desired lateral position.

Figure 3:
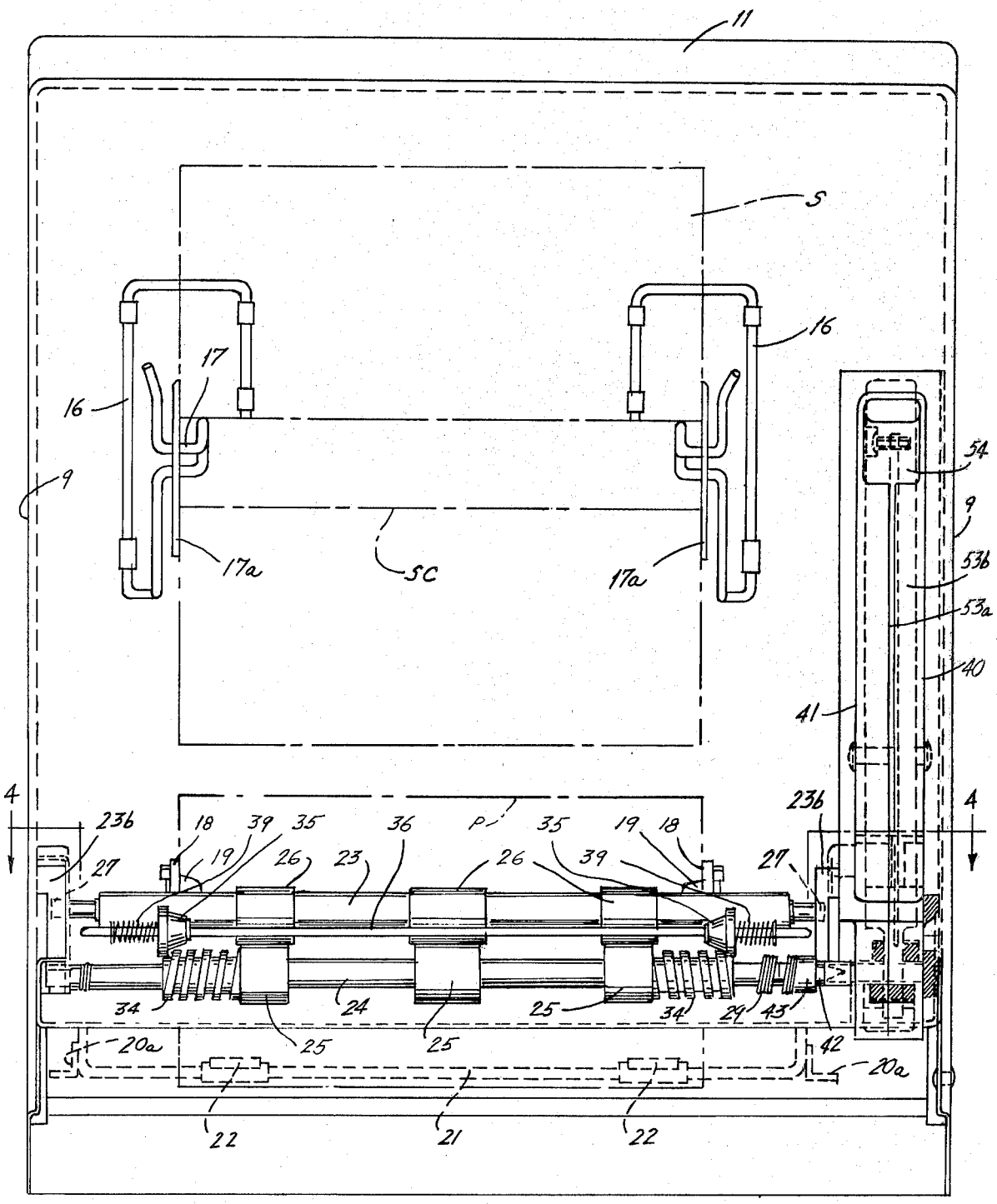
FIG. 3 is a front elevational view of the mechanism shown in FIGS. 1 and 2, with the front closure of the cabinet removed in order to disclose many of the parts lying within, this view illustrating the arrangement of the driving shafts and the transfer mechanism of the kind disclosed in the copending application above referred to, and also illustrating certain features of the novel lever operated feed mechanism provided in accordance with the present invention.
Figure 4:
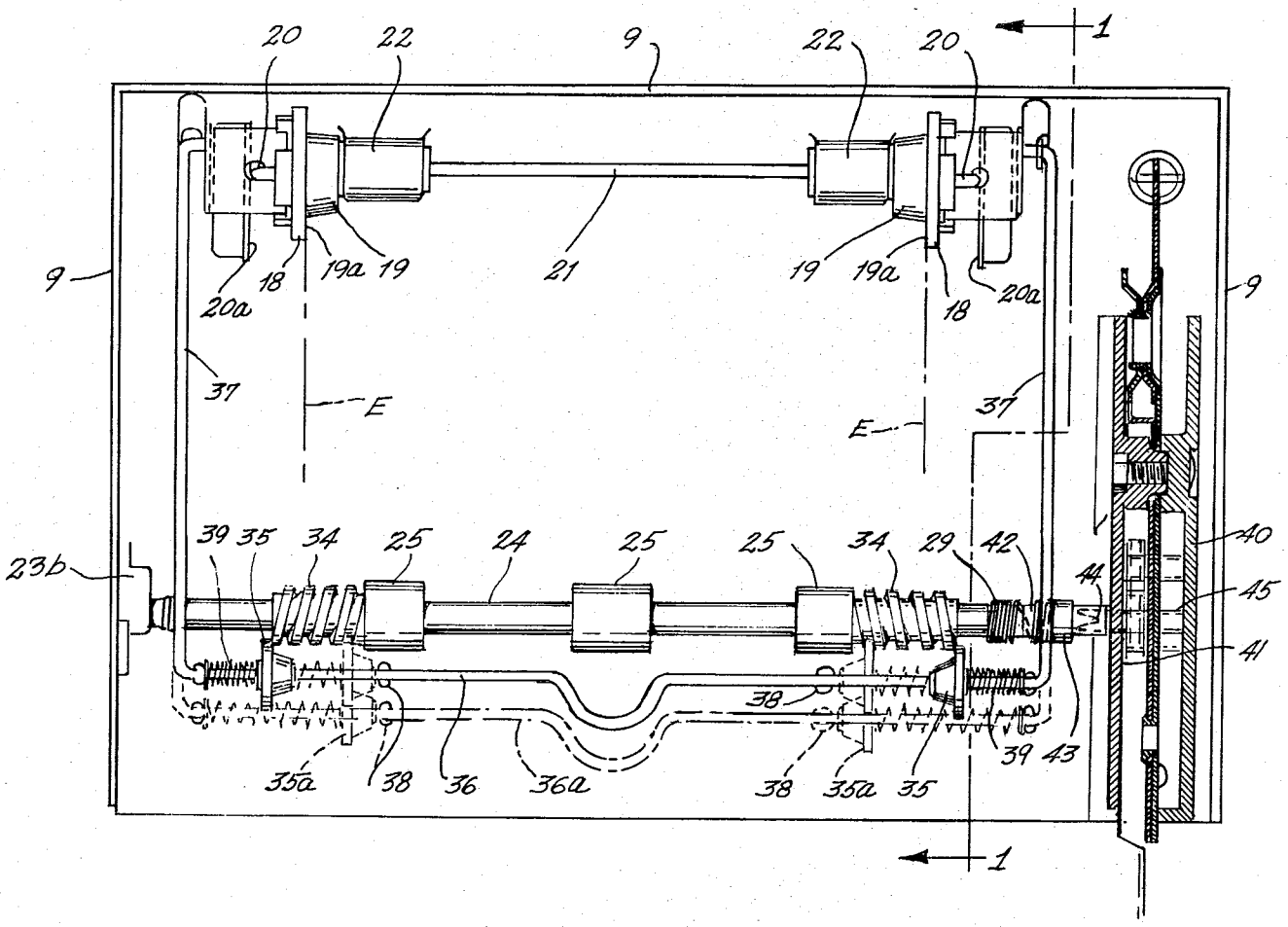
FIG. 4 is a horizontal sectional view through the cabinet and illustrating many of the internal operating parts in plan, this view being taken generally as indicated by the section line 4—4 on FIG. 3, but with the upper paper feed shaft omitted in order to show various of the underlying parts.

A primary roll in the first station (after having been transferred from the secondary station to the primary station) is indicated in various of the figures by the letter P; and when initially inserted in the primary station, the parts typically occupy the positions indicated in FIG. 1. From FIG. 1, it will be seen that the primary roll web PW is extended from the top of the roll P toward the feed mechanism, which comprises a pair of shafts 23,24. Referring particularly to FIGS. 3 and 4, it will be seen that the shaft 24 carries spaced cylindrical driving surfaces 25 adapted to cooperate with the cylindrical drive surfaces 26 formed on the upper shaft 23. The upper shaft 23 is journalled at its ends in fittings 23*b*, as indicated at 27. Toward the left, as viewed in FIGS. 3 and 4, the lower shaft 24 is also journalled in the fitting indicated at 23*b* at the left end. Toward the right hand end of the shaft 24, as viewed in FIGS. 2 and 3, the shaft 24 extends into a helical spring clutch of known type indicated at 29. The spring device 29 serves to drivingly interconnect the shaft 24 with the lever operated mechanism for rotating the shaft and effecting the feed or delivery of toweling from the dispenser. This device may be constructed to operate in the manner of a spring clutch automatically operating to prevent undesirable reverse rotation of the drive shaft 24.

For the purpose of increasing the frictional engagement of the pairs of driving surfaces 25-26, each surface 25 is preferably formed of a material having a relatively high coefficient of friction, such as rubber. The surfaces 26 need not necessarily be formed of high friction material; and in a typical embodiment, the shaft 23, including the drive surfaces 26, may conveniently be formed of wood. The two drive shafts 23 and 24 are desirably urged toward each other, for instance, by means of springs of the kind disclosed in the copending application above referred to, thereby maintaining the desired frictional gripping of the paper web as it is being delivered from the cabinet.

Referring further to FIGS. 1 and 2, it will be seen that the web PW from the primary roll extends over the top of the feed roll 23 and then downwardly and rearwardly into the nip between the pairs of driving surfaces 25-26. The web is then guided by the guide element 31 downwardly for discharge from the lower region of the cabinet, and a serrated cut-off knife 32 facilitates tearing off the dispensed length of the toweling.

As above noted, the position of the parts illustrated in FIG. 1 represents the condition immediately following the manual shifting of a roll from the secondary station into the primary station; and attention is now directed to the fact that the springs 33 tend to pull the pivotal mounting arms 20 for the primary roll rearwardly in the cabinet, thereby bringing the periphery of the primary roll against the back wall 10 of the cabinet, as is shown in FIG. 1. In this condition, therefore, the back wall, in effect, serves as a limiting stop for the rearward swinging of the primary roll.

Turning now to the transfer mechanism, attention is first directed to FIGS. 3 and 4. From these Figures, it will be seen that there are three cylindrical drive surfaces 25 mounted on the shaft 24, and further that the two outboard surfaces 25 are located in positions spaced somewhat inwardly from the ends of the shaft 24, and thus also inwardly of the position of the marginal edges of towel web being fed, such edges being indicated by broken lines marked by the letters E,E in FIG. 4. Outboard of each of the outer cylindrical drive surfaces 25, the shaft 24 carries a threaded device or section 34, the threaded sections being of sufficient length and being positioned to extend somewhat both beyond and inboard of the lines E,E representing the marginal edges of the web. For reasons which will be brought out hereinafter, the diameter of the threaded sections 34 on the shaft 24 is preferably smaller than the driving surfaces 25; and in addition, the outboard end portions of the shaft 24 extending beyond the threaded sections are preferably smaller in diameter than the base of the threads in the sections 34.

The threaded sections above referred to cooperate with transfer elements which are best seen in FIG. 4. The transfer elements comprise rotative rollers 35,35 which are mounted for free rotation on the shaft 36, which extends across the dispenser and which has end portions forming links 37,37 which project rearwardly to and are fastened to the pivotted roll supports 18. In view of this mounting of the follower or transfer rollers 35, the transfer rollers move forwardly or rearwardly with the pivotal motion of the arms 20 supporting the primary roll P.

Each of the follower or transfer rollers 35 is mounted for shifting movement along the support 36 between an inner position defined by the limiting stop 38, and a position just outboard of the outer end of the associated threaded section 34. A helical compression spring 39 urges the roller 35 inwardly against the stop 38; and in this position, the roller is located so that movement of the links 37 rearwardly will bring the roller into engagement with the thread of the threaded section 34, whereupon the roller acts as a follower during rotation of the threaded section under the influence of rotation by the drive means. The threads of the threaded sections 34 at opposite ends of the shaft 24 are of opposite hand and so arranged that upon rotation of the shaft 24 in the direction to feed the paper web through the feed nip, the follower rollers 35 are caused to move outwardly toward the outer ends of the shaft 24 beyond the threaded sections; and at this time, the follower rollers 35 will ride upon the smaller diameter outer end sections of the shaft 24 during the dispensing or feed of the last portions of the primary roll web. The follower rollers 35 will remain in this outer position until the mounting shaft 36 is again displaced to the position indicated at **36*a* in FIG. 4, at which time the rollers will again be moved inwardly toward each other by the springs 39. As shown, the threads of the sections 34 and the rollers 35** are of angular or square shape, thereby minimizing tendency for the rollers to creep out of the threads and slip from one groove of the thread to another groove.

As will be seen from FIG. 1, in the initial position of the parts after a primary roll P has been positioned in the primary station, the follower or transfer rollers 35 are maintained out of engagement with the threaded sections 34, this position being indicated not only in FIG. 1, but also by the dot and dash line position **36*a* of the mounting shaft 36 and the dotted position 35*a* of the rollers 35, as applied to FIG. 4**.

With this position of the parts, immediately after the primary roll has been inserted in the first or primary station, when a new reserve or secondary roll is placed in the cabinet, the web SW of the secondary roll is readily threaded downwardly behind the shaft 36 and the follower rollers 35, but in a position not in frictional engagement with the pairs of driving surfaces 25-26.

In normal use of the dispenser, the toweling web PW will continue to be drawn from the primary roll P; and this action will tend to tilt the pivotted mounting arms 20 for the primary roll forwardly, thereby causing the links 37 to displace the follower rollers 35 still farther away from the shafts 23,24 as compared with the position shown in FIG. 1. Therefore, the mounting of the primary roll P by means of the arms 20 positively precludes the transfer action until the primary roll is close to exhaustion. Moreover, as the primary roll approaches exhaustion, the tension in the primary roll web PW becomes increasingly effective to maintain the pivotal supports 20 for the primary roll in the forward position. The reason for this is that the primary roll supports, including parts 19 and **19*a*, apply friction to the primary roll (as is explained above) and; in addition, as the primary roll is depleted, the radius at which the tension in the web PW is applied to the primary roll progressively decreases. This, in turn, results in a given amount of tension in the web being more effective in maintaining the mounting arms 20 in the forward position. This differential action is of greater effect than the increase in the opposing force of the springs 33**. Being helical tension springs, the increase in the pull of the springs is relatively small.

Still further, the arrangement of the parts, including the mounting of the primary roll so that the web PW is drawn from the roll at the side thereof opposite to the pivot axis 21 for the arms 20, also results in maximizing the tendency for the feed tension in the web PW to maintain the arms 20 in their forwardly inclined position, i.e., the position in which the follower rollers 35 are maintained out of engagement with the threaded sections 34.

Various of the factors above cooperate in providing two important conditions tending to minimize undesired or premature transfer. First, the transfer is positively precluded by engagement of the primary roll with the back wall of the cabinet (the back wall acting as a limiting stop) until the primary roll approaches exhaustion. Second, the pivotal mounting of the primary roll and the path of feed of the web from the primary roll to the feed mechanism provides progressive increase in the forces tending to inhibit transfer until the point of actual exhaustion of the primary roll web. At the time of actual exhaustion of the primary roll web, the parts are caused to move toward the right as indicated in FIG. 2. Because of the exhaustion of the primary roll web, the tension in that web is no longer acting to pull the roll supports 18 forwardly, and the pivotal arms 20 are, therefore, drawn rearwardly by the springs 33. Consequently, the links 37, carrying the follower rollers 35, have been drawn rearwardly to bring the rollers into the threaded sections 34, and thereby the web SW of the secondary or reserve roll is caused to enter the feed mechanism. Initially, the feed rollers 35 engage the threads of the sections 34 in the marginal edge portions of the secondary web SW and the engagement of the rollers 35 with the threaded sections 34 with the web therebetween tends to apply a lateral spreading force to the web as the web enters the feed mechanism. Since the transfer rollers 35 are offset from the driving surfaces of the rollers 23 and 24, the periphery of the transfer rollers 35 will also deflect the paper against the surface of the shaft 23 in positions spaced outboard of the web gripping surfaces 26 and 25 of the rollers 23 and 24.

The use of follower or transfer elements, such as the rollers 35, at each side of the cabinet positioned to engage the opposite edge portions of the reserve roll web, assures the desired transfer, even in conditions where one corner or section of the reserve roll web is folded under or torn off, so that this transfer mechanism is more reliable than certain prior devices having only a single transfer mechanism.

After some of the secondary or reserve roll web has been dispensed, the servicing of the dispenser may proceed and, normally, would involve the removal of the empty core from the primary roll station and, thereafter, the positioning of the reserve roll in the primary roll station, as in FIG. 1, in accordance with the above description. Also, at that time, a new secondary or reserve roll is inserted in the secondary station.

The foregoing arrangement is highly effective in providing not only reliable transfer at the time when transfer is desired but also in preventing premature triggering of the transfer function.

Most of the parts, and the operation thereof, as described above are also disclosed in essentially the same manner in the companion application above identified; and for further description of the operation of those parts, reference may be made to the specification and drawings of the companion application.

One of the principal differences between the mechanism disclosed in the present application and that disclosed in the companion application is the employment in the dispenser of the present application of a lever actuator for the drive rolls, instead of the handcrank arrangement of the prior application.

Figure 7:
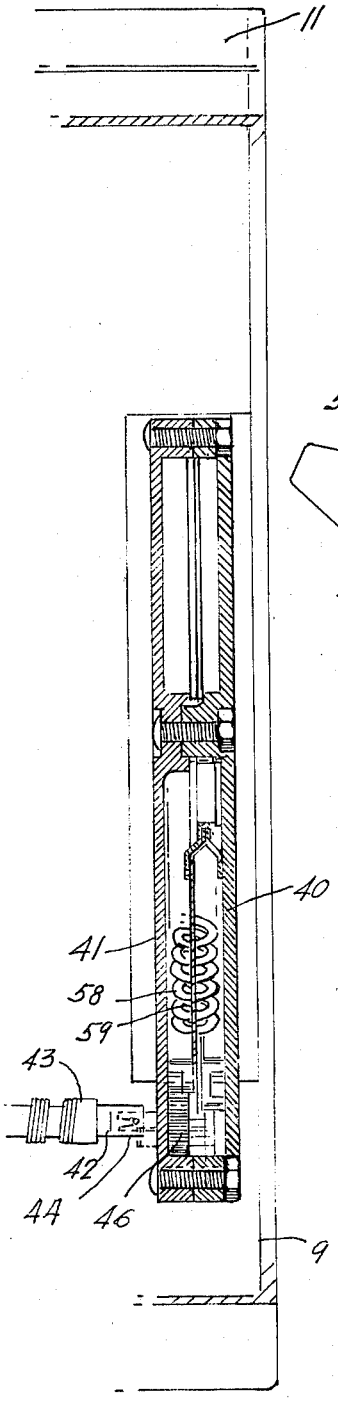
FIG. 7 is a transverse sectional view through the lever operated mechanism for driving the feed rolls.
Figure 5:
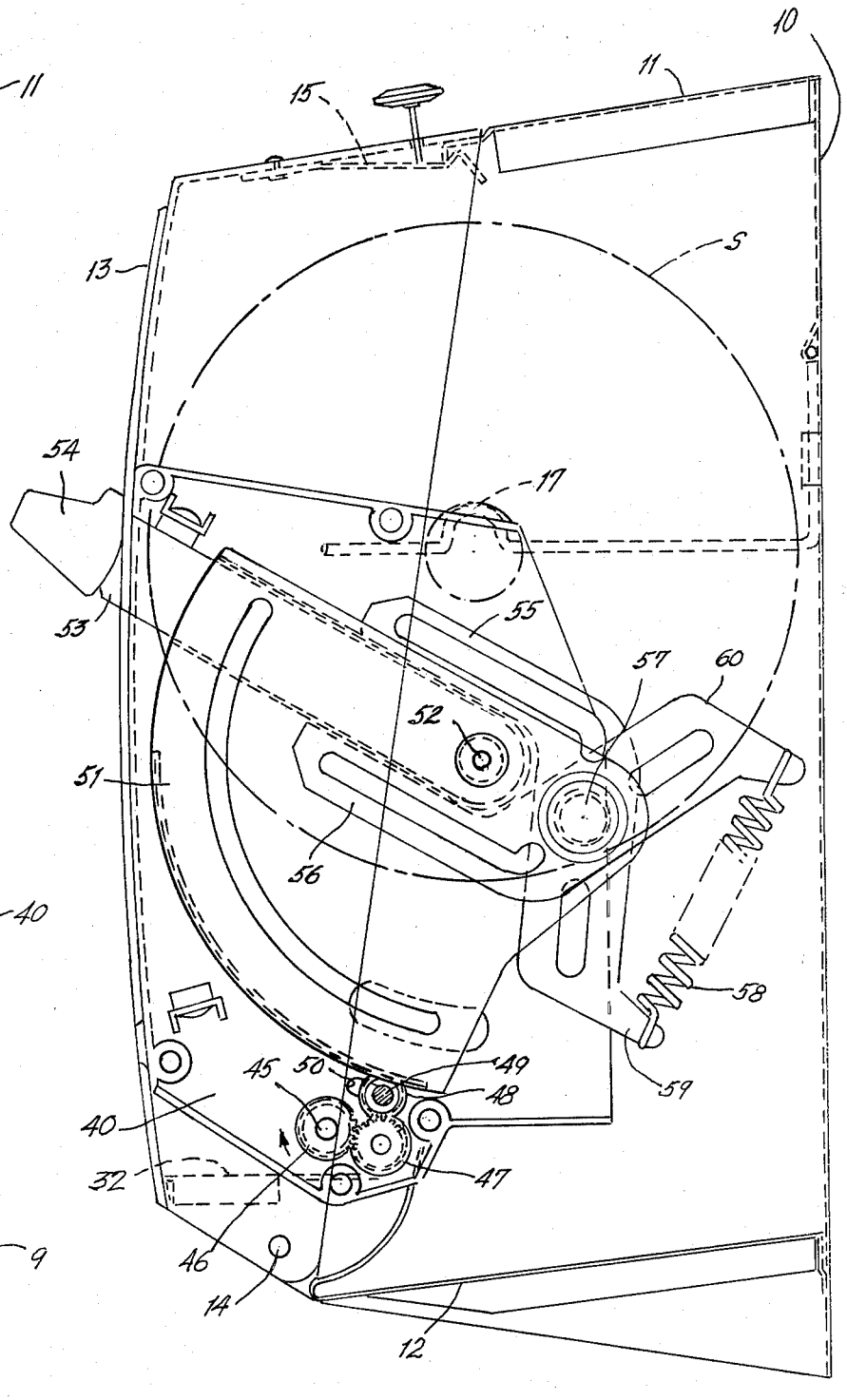
FIG. 5 is a side view of the cabinet, with an outline illustration of portions of the lever actuated mechanism for feeding or delivering the toweling from the cabinet, the lever being shown in this view at the upper end of its stroke and with certain of the drive parts in positions occupied during a normal downward stroke of the lever.

The lever actuated mechanism of the present application is mounted within an enclosure formed of a pair of mating side plates indicated at 40 and 41 (see particularly FIGS. 4 and 7). As seen particularly in FIGS. 3 and 4, the enclosure for the lever operating mechanism is positioned within the cabinet of the dispenser at the right hand end of the roll mounting and feed mechanism, as clearly appears in those figures. The driven shaft 24 of the pair of shafts which carry the driving surfaces 25-26 is connected through the spring clutch 29 with the stub shaft 42 which is journalled in a fixed part of the structure by the bearing 43. The stub shaft 42 is, in turn, adapted to be connected through the pin and slot joint 44 with a shaft 45 extended into and journalled in the enclosure formed by the plate members 40 and 41. Within this enclosure, this shaft 45 carries a gear 46 (see FIGS. 7, 5 and 6).

The gear 46 meshes with another gear 47 also mounted within the enclosure 40-41; and the gears 46 and 47 are adapted alternatively to be driven by the driving gear 48 having a mounting shaft 49 carried by a shaft which is shiftable in arcuate slots, such as indicated at 50 in the side walls 40 and 41 of the enclosure for the gearing.

The driving gear 48 is adapted to be rotated by engagement with the teeth on the arcuate rack 51 (see FIGS. 5 and 6); and the arcuate rack 51 is pivotally mounted on the axis or pivot 52 journalled in the side plates 40-41. A lever 53 is also mounted upon and extends from the pivot 52 forwardly through a slot **53*a* (see FIG. 3) formed in a front edge cover or escutcheon plate 53*b* bridging the space between the forward edges of the side plates 40 and 41, as clearly appears in FIG. 3; and the lever 53 has a handle or knob 54** for convenient manual operation of the lever.

By providing the cover or escutheon plate **53*b* at the front edge of the plates 40 and 41, and by providing an opening in the front wall of the cover or door 13 of the dispenser cabinet, the opening in the cover being proportioned to receive the escuthcheon plate, provision is made for opening and closing of the cover without the necessity of removing the lever knob 54**.

The motion of the lever is transmitted to the rack 51 by means of the abutment members 55 and 56 which are interconnected by means of the pivot 57, which is also mounted on the arcuate rack 51. The abutments 55 and 56 are urged toward each other and against the opposite edges of the lever 53 by means of the spring 58 acting through the arms 50 and 60, which are respectively connected with the abutments 55 and 56.

In all normal operation of the lever, the abutments 55 and 56 remain in engagement with the edges of the lever 53, so that the arcuate rack, the abutments, the arms 59 and 60 and the spring 58, all move pivotally with the lever about the axis of the lever pivot 52. When the lever is moved downwardly from the position shown in FIG. 5, the teeth on the edge of the rack 51 in engagement with the driving pinion or gear 48, cause that gear to shift to a position meshing with the gear 47; and the drive force is thereby transmitted from the driving gear 48 to the gear 47, thereby resulting in rotation of the gear 47 in the direction indicated by the arrow. This, in turn, causes rotation of the driven gear 46 in the direction indicated by the arrow, which is the direction required of the shaft 24, in order to dispense paper webbing from the cabinet.

Figure 6:
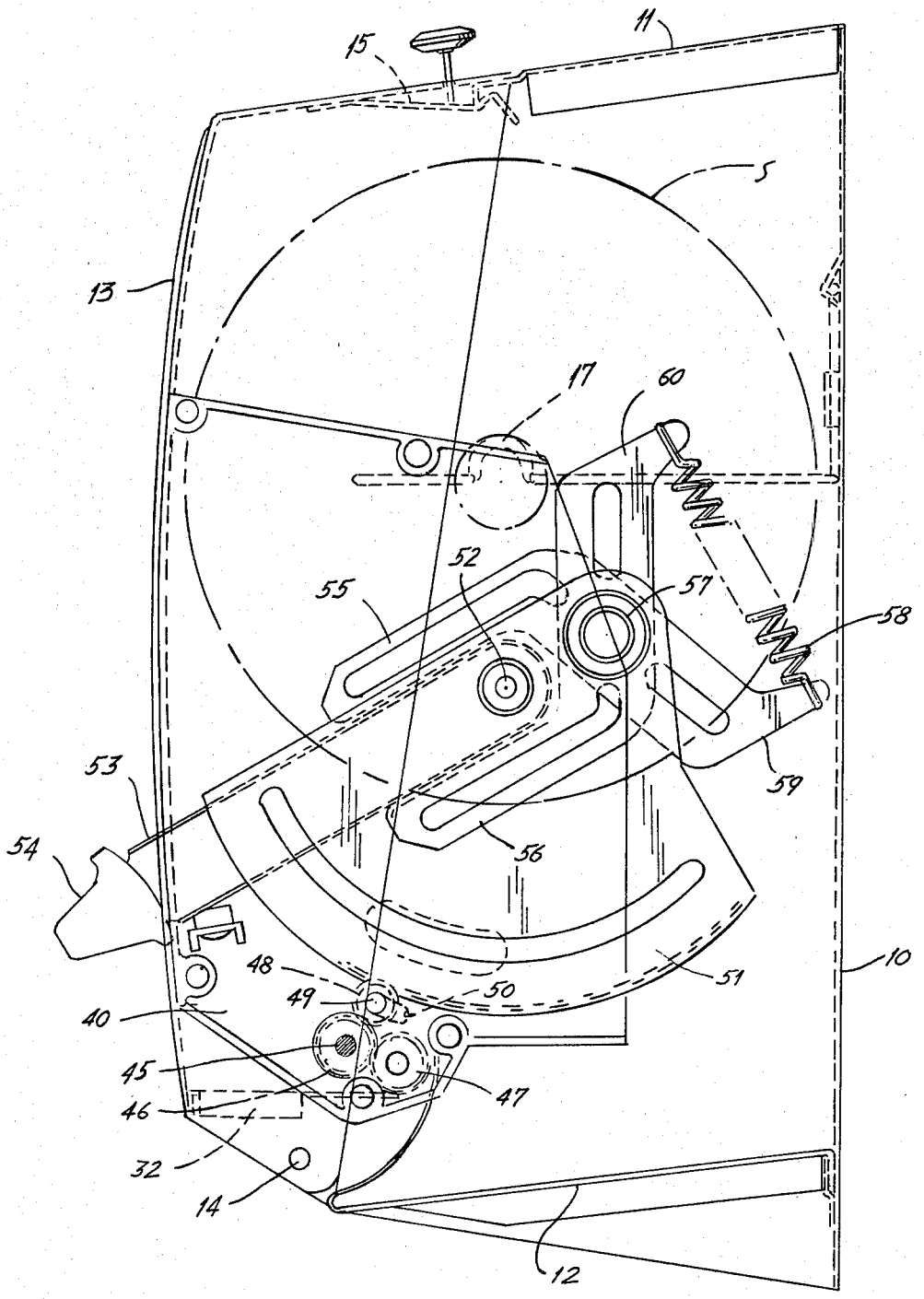
FIG. 6 is a view similar to FIG. 5 but illustrating the lever in its lower position and with certain of the drive parts in positions occupied during a normal upward stroke of the lever.

After the lever has been swung downwardly as described just above, it will occupy the lower position, as shown in FIG. 6; and the lever is then in position to initiate the upward stroke in order to effect further dispensing of toweling. At this time, the teeth on the arcuate rack 51 cause the shiftable driving gear 48 to shift to the other end of the slot 50 in which the driving gear 50 meshes with the driven gear 46, with resultant rotation of the driven gear in the direction indicated by the arrow, i.e., the same direction as that shown in FIG. 5, with resultant further dispensing of the paper web. At this time, the intermediate gear 47 merely rotates as an idler.

The provision of the abutments 55 and 56 and the spring 58 in association with the lever 53 and the arcuate rack 51 provides certain safety features which will protect the dispenser in the event of improper overload of the operating lever; and this provision is effective in either direction of operation of the two-way lever herein disclosed.

Figure 8:
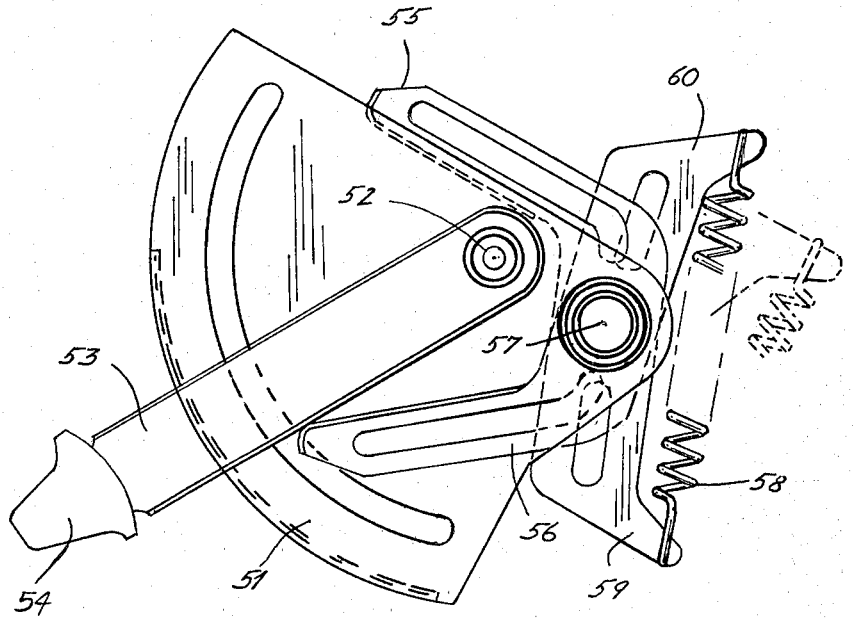
FIGS. 8 and 9 are fragmentary views of certain of the operating parts in two additional positions to be described more fully hereinafter.
Figure 9:
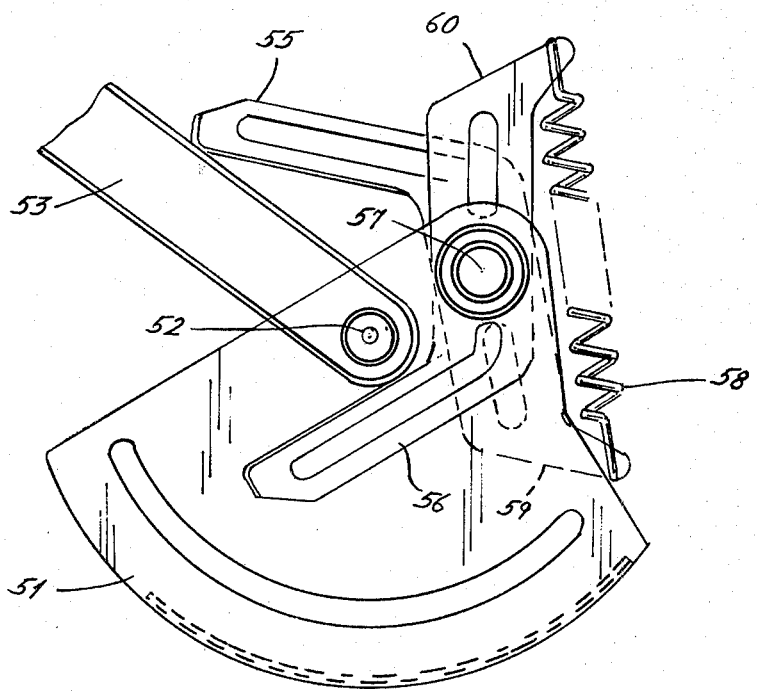

The manner in which this mechanism operates will be clear from inspection and comparison of FIGS. 8 and 9. In FIG. 8, an overload in the downward direction of the lever 53 is indicated; and it will be noted that the abutment 56 has been displaced, with consequent extension of the spring 58, which normally holds the two abutments against the opposite edges of the lever.

A similar condition, but in the opposite direction, is illustrated in FIG. 9.

The arrangement of the abutments 55 and 56 and the spring 58 thus provides a mechanism by which in all normal operation of the lever, the arcuate rack 51 will move with the lever; but in the event of abnormal force being applied to the lever in either direction, the spring will yield and prevent damage to the operating parts.

We claim:

1. A towel dispenser for sequentially feeding towel webs from a primary roll in a first station, and a secondary roll in a second station, towel feed mechanism including a pair of parallel shafts having at least one pair of cylindrical web gripping and feeding surfaces providing a feed nip for paper webs delivered from rolls in said stations and being located inboard of the lateral edges of a paper web engaged in said feed nip, drive means for rotating one of said shafts, the drive means comprising a pair of meshing gears, one of which is connected with one of said shafts, and a driving gear shiftably mounted to alternatively engage one or the other of the gears of said pair, and manually operated means for effecting rotation of said driving gear, mounting means for a primary paper roll in said first station with the primary roll web extended through said feed nip to effect dispensing of said primary roll web, mounting means for a secondary roll in said second station with the secondary roll web lying in a path extended past said parallel shafts in spaced relation to the input side of said feed nip, and mechanism for gripping the marginal edge portions of the secondary roll web outboard of the cylindrical feeding surfaces, said mechanism providing for laterally tensioning the secondary roll web and for bringing the laterally tensioned web into said feed nip.

2. A towel dispenser as defined in claim 1, in which the manually operated means for effecting rotation of the driving gear comprises a pivotted lever, and means providing for shifting of the shiftable gear from a position meshing with one of the gears of said pair to a position meshing with the other gear of said pair upon pivotal movement of the lever in one direction or the other.

3. A towel dispenser as defined in claim 2, in which the means for effecting rotation of the driving gear comprises a rack connected with the lever and having teeth meshing with the shiftable gear.

4. A towel dispenser for dispensing a towel roll web comprising a pair of parallel shafts having at least one pair of cylindrical web gripping and feeding surfaces providing a feed nip for the roll web, drive mechanism for rotating one of said shafts, the drive mechanism comprising a pair of meshing gears, one of which is connected with one of said shafts, a driving gear shiftably mounted for alternatively engaging one or the other of the gears of said pair, and a manually operable pivotted lever for rotating and shifting said driving gear.

5. A towel dispenser as defined in claim 4, in which the drive mechanism further includes a toothed rack meshing with the shiftably mounted gear and connected with the manually operable lever.

6. A towel dispenser as defined in claim 5, and further including a connection mechanism interconnecting the rack with the lever, a connection mechanism comprising a pair of clamp elements pivotted to the rack upon a common axis offset from the lever pivot, and yielding means reacting between the pair of clamp elements urging them into clamping engagement with the lever, but providing for movement of the lever independently of the rack.

* * * * *